US008847859B2

(12) United States Patent
Fish et al.

(10) Patent No.: US 8,847,859 B2
(45) Date of Patent: Sep. 30, 2014

(54) LIGHT EMITTING DISPLAY DEVICES

(75) Inventors: David A. Fish, Haywards Heath (GB); John R. Hughes, Horley (GB); Steven C. Deane, Redhill (GB)

(73) Assignee: Koninklijke Philips N.V., Eindhoven (NL)

( * ) Notice: Subject to any disclaimer, the term of this patent is extended or adjusted under 35 U.S.C. 154(b) by 1562 days.

(21) Appl. No.: 10/562,276

(22) PCT Filed: Jun. 18, 2004

(86) PCT No.: PCT/IB2004/002057

§ 371 (c)(1),
(2), (4) Date: Dec. 22, 2005

(87) PCT Pub. No.: WO2004/114273

PCT Pub. Date: Dec. 29, 2004

(65) Prior Publication Data

US 2006/0145969 A1 Jul. 6, 2006

(30) Foreign Application Priority Data

Jun. 26, 2003 (GB) ..... 0314895.4

(51) Int. Cl.

| | |
|---|---|
| ***G09G 3/30*** | (2006.01) |
| ***G09G 3/34*** | (2006.01) |
| ***G09G 3/10*** | (2006.01) |
| *G09G 3/32* | (2006.01) |

(52) U.S. Cl.

CPC ..... *G09G 3/3233* (2013.01); *G09G 2320/043* (2013.01); *G09G 2320/0223* (2013.01); *G09G 2300/0809* (2013.01); *G09G 3/3275* (2013.01); *G09G 2330/12* (2013.01); *G09G 2320/029* (2013.01); *G09G 2320/0285* (2013.01); *G09G 2320/0214* (2013.01)

USPC ..... 345/77; 345/84; 345/82; 345/204; 345/690; 315/169.3

(58) Field of Classification Search

CPC ..... G09G 2320/0233; G09G 2320/0209; G09G 2320/0204

USPC ..... 345/28, 30, 55, 76, 77, 78, 79, 80, 81, 345/82, 83, 204, 205, 206, 207, 208, 209, 345/210, 211, 214, 215, 690, 691, 692, 693, 345/694; 315/169.1, 169.2, 169.3, 366

See application file for complete search history.

(56) References Cited

U.S. PATENT DOCUMENTS 5,734,361 A * 3/1998 Suzuki et al. ..... 345/74.1
5,886,474 A * 3/1999 Asai et al. ..... 315/169.1

(Continued)

FOREIGN PATENT DOCUMENTS

EP 1225557 A1 7/2002
EP 1225557 A1 7/2002

(Continued)

*Primary Examiner* — Lun-Yi Lao
*Assistant Examiner* — Ibrahim Khan

(57) ABSTRACT

A method is provided of determining the pixel drive signals to be applied to the pixels of an array of light emitting display elements arranged in rows and columns, with a plurality of the pixels in a row being supplied with current simultaneously along a respective row conductor. Target pixel drive currents are determined from a model of the pixel current-brightness characteristics. These are modified to take account of the voltage on the respective row conductor at each pixel resulting from the currents drawn from the row conductor by the plurality of pixels and the dependency of the pixel brightness characteristics on the voltage on the row conductor at the pixel. This addresses the problem of horizontal cross-talk that occurs in active matrix LED displays due to the finite output impedance of the current providing TFTs as well as the finite resistance of metals used to form power supply lines.

14 Claims, 6 Drawing Sheets

(56) References Cited

U.S. PATENT DOCUMENTS

| | | | | |
|---|---|---|---|---|
| 6,014,119 | A | 1/2000 | Staring et al. | |
| 6,177,767 | B1 * | 1/2001 | Asai et al. | 315/169.1 |
| 6,232,944 | B1 | 5/2001 | Kumagawa et al. | |
| 6,400,348 | B1 | 6/2002 | Young | |
| 6,448,718 | B1 | 9/2002 | Battersby | |
| 6,587,086 | B1 * | 7/2003 | Koyama | 345/77 |
| 6,930,662 | B2 * | 8/2005 | Aoki | 345/87 |
| 7,071,635 | B2 * | 7/2006 | Inoue et al. | 315/366 |
| 7,227,519 | B1 * | 6/2007 | Kawase et al. | 345/77 |
| 7,358,939 | B2 * | 4/2008 | Kim et al. | 345/77 |
| 2002/0044123 | A1 | 4/2002 | Aoki | |
| 2002/0175885 | A1 * | 11/2002 | Cok | 345/82 |
| 2004/0004591 | A1 * | 1/2004 | Akimoto et al. | 345/84 |
| 2004/0183483 | A1 | 9/2004 | Inoue et al. | |

FOREIGN PATENT DOCUMENTS

| | | | | |
|---|---|---|---|---|
| EP | 1439518 | A | 7/2004 | |
| EP | 1439518 | A1 | 7/2004 | |
| WO | WO 01/99195 | A1 * | 12/2001 | H01L 27/15 |
| WO | 03027999 | A1 | 4/2003 | |
| WO | WO03027999 | A | 4/2003 | |

* cited by examiner

LIGHT EMITTING DISPLAY DEVICES

This invention relates to light emitting display devices, for example electroluminescent displays, particularly active matrix display devices having thin film switching transistors associated with each pixel.

Matrix display devices employing electroluminescent, light-emitting, display elements are well known. The display elements may comprise organic thin film electroluminescent elements, for example using polymer materials, or else light emitting diodes (LEDs) using traditional III-V semiconductor compounds. Recent developments in organic electroluminescent materials, particularly polymer materials, have demonstrated their ability to be used practically for video display devices. These materials typically comprise one or more layers of a semiconducting conjugated polymer sandwiched between a pair of electrodes, one of which is transparent and the other of which is of a material suitable for injecting holes or electrons into the polymer layer.

The polymer material can be fabricated using a CVD process, or simply by a spin coating technique using a solution of a soluble conjugated polymer. Ink-jet printing may also be used. Organic electroluminescent materials exhibit diode-like I-V properties, so that they are capable of providing both a display function and a switching function, and can therefore be used in passive type displays. Alternatively, these materials may be used for active matrix display devices, with each pixel comprising a display element and a switching device for controlling the current through the display element.

Display devices of this type have current-driven display elements, so that a conventional, analogue drive scheme involves supplying a controllable current to the display element. It is known to provide a current source transistor as part of the pixel configuration, with the gate voltage supplied to the current source transistor determining the current through the display element. A storage capacitor holds the gate voltage after the addressing phase.

FIG. 1 shows a known pixel circuit for an active matrix addressed electroluminescent display device. The display device comprises a panel having a row and column matrix array of regularly-spaced pixels, denoted by the blocks 1 and comprising electroluminescent display elements 2 together with associated switching means, located at the intersections between crossing sets of row (selection) and column (data) address conductors 4 and 6. Only a few pixels are shown in the Figure for simplicity. In practice, there may be several hundred rows and columns of pixels. The pixels 1 are addressed via the sets of row and column address conductors by a peripheral drive circuit comprising a row, scanning, driver circuit 8 and a column, data, driver circuit 9 connected to the ends of the respective sets of conductors.

The electroluminescent display element 2 comprises an organic light emitting diode, represented here as a diode element (LED) and comprising a pair of electrodes between which one or more active layers of organic electroluminescent material is sandwiched. The display elements of the array are carried together with the associated active matrix circuitry on one side of an insulating support. Either the cathodes or the anodes of the display elements are formed of transparent conductive material. The support is of transparent material such as glass and the electrodes of the display elements 2 closest to the substrate may consist of a transparent conductive material such as ITO so that light generated by the electroluminescent layer is transmitted through these electrodes and the support so as to be visible to a viewer at the other side of the support.

FIG. 2 shows in simplified schematic form a known pixel and drive circuitry arrangement for providing voltage-programmed operation. Each pixel 1 comprises the EL display element 2 and associated driver circuitry. The driver circuitry has an address transistor 16 which is turned on by a row address pulse on the row conductor 4. When the address transistor 16 is turned on, a voltage on the column conductor 6 can pass to the remainder of the pixel. In particular, the address transistor 16 supplies the column conductor voltage to a current source 20, which comprises a drive transistor 22 and a storage capacitor 24. The column voltage is provided to the gate of the drive transistor 22, and the gate is held at this voltage by the storage capacitor 24 even after the row address pulse has ended. The drive transistor 22 draws a current from the power supply line 26.

The drive transistor 22 in this circuit is implemented as a p-type TFT, so that the storage capacitor 24 holds the gate-source voltage fixed. This results in a fixed source-drain current through the transistor, which therefore provides the desired current source operation of the pixel.

The above basic pixel circuit is a voltage-programmed pixel, and there are also current—programmed pixels which sample a drive current. However, all pixel configurations require current to be supplied to each pixel.

One problem with LED displays arises from the significant currents drawn by the pixels. The displays are typically backward-emitting, through the substrate carrying the active matrix circuitry. This is the preferred arrangement because the desired cathode material of the EL display element is opaque, so that the emission is from the anode side of the EL diode, and furthermore it is not desirable to place this preferred cathode material against the active matrix circuitry. Metal row conductors are formed to define power supply lines, and for these backward emitting displays they need to occupy the space between display areas, as they are opaque. For example, in a 12.5 cm (diagonal) display, which is suitable for portable products, the row conductor may be approximately 11 cm long and 20 μm wide. For a typical metal sheet resistance of 0.2 Ω/square, this gives a line resistance for a metal row conductor of 1.1 kΩ. A bright pixel may draw around 8 μA, and the current drawn is distributed along the row. The significant row conductor resistance gives rise to voltage drops along the row conductors, and these voltage variations along the power supply line alter the gate-source voltage on the drive transistors, and thereby affect the brightness of the display. Furthermore, as the currents drawn by the pixels in the row are image-dependent, it is considered difficult to correct the pixel drive levels by data correction techniques, and the distortion is essentially a cross talk between pixels in different columns.

The voltage drops can be reduced by a factor of 4 by drawing current from both ends of the row, and improvements in efficiency of the EL materials can also reduce the current drawn. Nevertheless significant voltage drops are still present. These voltage drops also give rise to performance limitations in current mirror pixel circuits (in which the pixel is current—addressed rather than voltage—addressed). In addition, thin film transistors are inherently non-ideal current source devices, as the output current will in fact depend on both the source and drain voltages rather than only on the gate-source voltage. Thus the output impedance of the TFT used as a current source will also create horizontal cross talk.

Voltage drops along the row conductor not only affect the gate-source voltage for a given applied gate voltage (because the source is connected to the row conductor) but also mean that the drain-source voltage of the current-providing TFT will be reduced. The finite output impedance of the current-providing TFT then results in a reduction in its current. This change in current will again depend upon the current been drawn from all of the other pixels in the row, the TFT output impedance for the particular operating conditions, and the OLED I-V characteristic. In particular, the consequent changes in the anode voltage of the OLED display element will alter the brightness output of the display element for a given current.

Signal processing schemes have been suggested for overcoming horizontal cross-talk that occurs through a data voltage error caused by power line voltage drops. Such schemes are not suitable for the correction of horizontal cross-talk caused by the in-pixel current source TFT output impedance. Instead, they simply return the gate-source voltage to the originally intended value, without compensating for the other changes in the current and voltage operating points within the pixel.

According to the invention, there is provided a method of determining the pixel drive signals to be applied to the pixels of an array of light emitting display elements arranged in rows and columns, with a plurality of the pixels in a row being supplied with current simultaneously along a respective row conductor, the method comprising:

determining target pixel drive currents corresponding to desired pixel brightness levels based on a model of the pixel current-brightness characteristics;

modifying the target pixel drive currents to take account of:

the voltage on the respective row conductor at each pixel resulting from the currents drawn from the row conductor by the plurality of pixels; and the dependency of the pixel brightness characteristics on the voltage on the row conductor at the pixel; and determining the pixel drive signals from the modified target pixel drive currents.

By taking into account the dependency of the pixel brightness characteristics on the voltage on the row conductor at the pixel, the invention addresses the problem of horizontal cross-talk that occurs in active matrix LED displays due to the finite output impedance of the current providing TFTs as well as the finite resistance of metals used to form power supply lines. The invention provides a signal processing scheme for correction of the cross-talk. The model used to form the target drive currents can assume a constant row voltage on the row conductor, and is thus a constant model for all pixels and independent of the pixel drive signals applied to other pixels.

The compensation for the dependency of the pixel brightness characteristics on the voltage on the row conductor at the pixel takes into account not only the effective change in the pixel drive signal (for example the change in gate-source voltage for the drive transistor in the pixel configuration of FIG. 2) but also the change in the operating point of the pixel components (for example the drain voltage of the drive transistor in the pixel configuration of FIG. 2).

The technique of the invention is applicable to amorphous silicon and polysilicon technologies for any array that uses power lines which supply current to rows of current-drawing pixels. It should be noted that the terms "row" and "column" used herein are somewhat arbitrary, and these terms are merely intended to denote an array of device elements arranged in an orthogonal matrix.

Each pixel may comprise a drive transistor and a light emitting display element in series between the row conductor and a common line (for example ground). Taking account of the dependency of the pixel brightness characteristics on the voltage on the row conductor at the pixel then includes taking account of any change in drain-source voltage and the gate-source voltage of the drive transistor resulting from the row conductor voltage.

Each pixel is preferably programmed in a first phase and driven in a second phase, and wherein the step of modifying the target pixel drive currents further takes account of any differences in the current drawn by the pixels between the first and second phases. In particular, some pixel drive schemes involve supplying more or less current in the programming phase than during driving of the pixel. By taking this into account, correct compensation can be provided for any pixel drive scheme.

The step of modifying the target pixel drive currents may comprise:

applying an algorithm to the target pixel drive currents which represents the relationship between the currents drawn by the pixels in a row and the voltages on the row conductor at the locations of the pixels; and scaling the resulting values using a value representing the dependency of the pixel brightness characteristics on the voltage on the row conductor.

Thus, separate processing is required to compensate for the row voltage changes and for the effect of the change in the operating point of the pixel on the output brightness.

For example, applying an algorithm may comprise multiplying a vector of the target pixel drive currents for a row of pixels by the inversion of the matrix M, in which:

$$M = \begin{bmatrix} -2 & 1 & & & & \\ 1 & -2 & 1 & & & \\ & \iddots & \iddots & \iddots & & \\ & & 1 & -2 & 1 & \\ & & & 1 & -2 & \end{bmatrix},$$

and wherein the number of rows and columns of matrix M is equal to the number of pixels in the row.

When each pixel comprises a current source circuit which converts an input voltage to a current using a drive transistor, the scaling may comprise using a value including terms derived from:

the voltage-current characteristics of the drive transistor; and the voltage-current characteristics of the light emitting display element.

The scaling also including a term derived from the resistance of the row conductor.

In one example, the scaling comprises using a value $(1-\alpha)R\lambda/(1+\lambda/\mu)$, where R is the resistance of the row conductor between adjacent pixels;

$\lambda$ is the slope of the drain-source current vs. drain-source voltage curve of the drive transistor;

$\mu$ is the slope of the current vs. voltage curve of the display element; and $\alpha$ is the ratio of the current drawn by a pixel during a pixel programming phase to the current drawn by the pixel during display.

In order to reduce the computational overhead, the result of multiplying a vector of the target pixel drive currents for a row of pixels by the inversion of the matrix M can be obtained by a recursive operation:

$$F(n) = F(n-1) + \sum_{j=0}^{n-1} I(j) + F(0),$$

in which:

F(n) is the nth term of a the vector result of multiplying the vector of the target pixel drive currents for a row of pixels by the inversion of the matrix M, F(0) being the first term; and I(j) is the target current for the jth pixel in a row, the first pixel being j=0.

In this recursive model:

$$F(0) = \frac{1}{N+1}\sum_{j=0}^{N-1}(N-j)I(j),$$

in which:

N is the total number pixels in the row.

The values representing the dependency of the pixel brightness characteristics on the voltage on the row conductor used for scaling are stored in a look up table, having current values as an input parameter. These look up table parameters can be updated over time to enable changes in pixel brightness characteristics over time to be modeled.

The method of the invention can be used for driving an active matrix array of current-addressed light emitting display elements arranged in rows and columns, in which each row of pixels is addressed in a sequence.

The invention also provides a display device comprising an active matrix array of current-addressed light emitting display elements arranged in rows and columns, comprising:

compensation circuitry for modifying the target pixel drive currents to take account of the voltage on the respective row conductor at each pixel resulting from the currents drawn from the row conductor by the plurality of pixels and the dependency of the pixel brightness characteristics on the voltage on the row conductor at the pixel, the compensation circuitry comprising:

means for applying an algorithm to the target pixel drive currents which represents the relationship between the currents drawn by the pixels in a row and the voltages on the row conductor at the locations of the pixels; and means for scaling the resulting values using a value representing the dependency of the pixel brightness characteristics on the voltage on the row conductor.

Examples of the invention will now be described in detail with reference to the accompanying drawings, in which.

The invention provides a scheme for determining the pixel drive signals to be applied to the pixels of an array of light emitting display elements. A set of standard pixel drive currents, corresponding to desired pixel brightness levels, are modified to take account of both the voltage variations on the row conductor as well as the dependency of the pixel brightness characteristics on the voltage on the row conductor.

In order to derive an algorithm for the correction of the horizontal cross-talk, the following steps are taken:

a general expression for voltage drops on the power line is obtained, for any combination of currents drawn by the pixels on a line;

the current change resulting from the power line voltage drops and the output impedance of the in-pixel current source TFT is then determined; and a correction scheme for the data is derived to compensate for horizontal cross talk.

The analysis below assumes that the power line is driven from both ends. However, it will be appreciated than the analysis can however be performed for a row conductor driven at one end.

Figure 3:
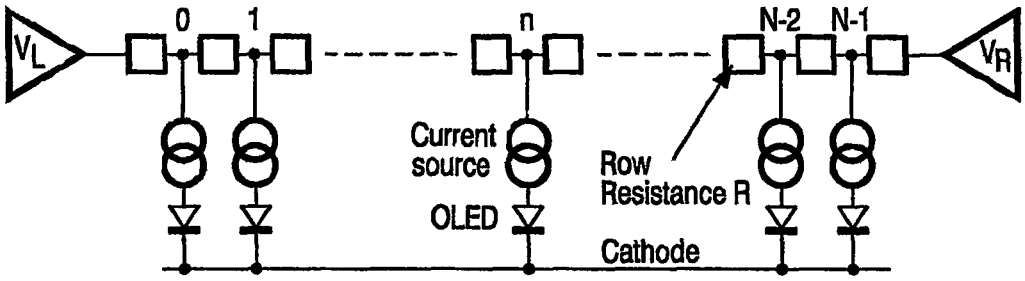
FIG. 3 is an equivalent circuit used to derive the relationship between pixel currents and voltages on the row conductor.

In the this analysis, the power line can be assumed to comprise a row that has voltage sources at both ends of the row to supply current to every pixel in the row. Initially, it can be assumed that every pixel contains a perfect current source drawing current from the power line and providing it to the OLED. The equivalent circuit for the model is shown in FIG. 3.

The following expression can be derived for the current to the pixel at node n in terms of the voltages on the power line at node n−1, n and n+1. The resistance of the power line between nodes is R.

$$\begin{aligned} I(n) &= \frac{1}{R}(\mathrm{V}(n-1)-\mathrm{V}(n)) + \frac{1}{R}(\mathrm{V}(n+1)-\mathrm{V}(n)) \\ &= \frac{1}{R}(\mathrm{V}(n-1)-2\mathrm{V}(n)+\mathrm{V}(n+1)) \end{aligned} \tag{1}$$

The current I(n) is known as this has been programmed into the pixel current source so the need is to solve (1) for the voltage V(n) to calculate the power line voltage drops. Writing out all the terms:

$$\begin{aligned} I(0)R &= V_L - 2\mathrm{V}(0) + \mathrm{V}(1) \\ I(1)R &= \mathrm{V}(0) - 2\mathrm{V}(1) + \mathrm{V}(2) \\ &\vdots \\ I(N-1)R &= \mathrm{V}(N-2) - 2\mathrm{V}(N-1) + V_R \end{aligned}$$

Where $V_L$ and $V_R$ are the voltage sources at either end of the power line. Then in matrix form:

$$RI = M\cdot\mathrm{V} + V_b \tag{2}$$

where $$I = \begin{bmatrix} I(0) \\ I(1) \\ \vdots \\ I(N-2) \\ I(N-1) \end{bmatrix},\quad \mathrm{V} = \begin{bmatrix} \mathrm{V}(0) \\ \mathrm{V}(1) \\ \vdots \\ \mathrm{V}(N-2) \\ \mathrm{V}(N-1) \end{bmatrix},\quad V_b = \begin{bmatrix} V_L \\ 0 \\ \vdots \\ 0 \\ V_R \end{bmatrix}$$

and $$M = \begin{bmatrix} -2 & 1 & & & \\ 1 & -2 & 1 & & \\ & \ddots & \ddots & \ddots & \\ & & 1 & -2 & 1 \\ & & & 1 & -2 \end{bmatrix}$$

The voltages on the power supply line are found by inverting equation (2) i.e.

$$V = M^{-1}(RI - V_b) \tag{3}$$

Figure 4:
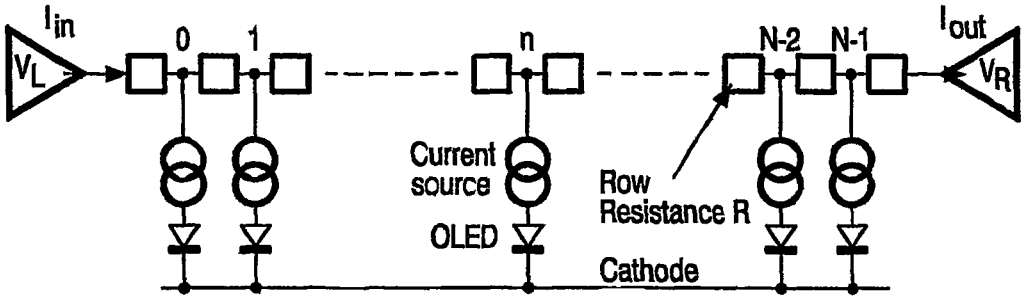
FIG. 4 is an equivalent circuit used to derive the inverse relationship to that investigated with FIG. 3.

For a given size matrix M, the inverse can be obtained simply by standard mathematical techniques. In particular, the matrix M is a tridiagonal matrix symmetrical matrix, and the inverse is easily obtained. To obtain a general inverse for all possible matrix dimensions, it is possible to look at the voltages and currents in the power supply line a little differently. FIG. 4 is essentially the same as FIG. 3 but it shows the currents supplied by the voltage sources at either end of the power rail $I_{in}$ and $I_{out}$.

The voltages at the nodes 0, 1, 2 . . . n can now be written in the following way $$V(0) = V_L - RI_{in} \tag{3a}$$

$$V(1) = V_L - RI_{in} - R(I_{in} - I_0)$$

$$V(2) = V_L - RI_{in} - R(I_{in} - I_0) - R(I_{in} - I_0 - I_1)$$

$$\vdots$$

$$V(n) = V_L - R(n+1)I_{in} + R\sum_{j=0}^{n-1}(n-j)I(j)$$

$$\vdots$$

$$V(N-1) = V_L - RNI_{in} + R\sum_{j=0}^{N-2}(N-1-j)I(j)$$

In order to eliminate $I_{in}$ from the above system of equations, the following relations are used:

$$V(N-1) = V_R + RI_{out} \tag{3b}$$

$$I_{out} = I_{in} + \sum_{j=0}^{N-1} I_j$$

Using equations (3b) in (3a) at node N−1 an expression for $I_{in}$ is obtained:

$$I_{in} = \frac{1}{N+1}\left(\frac{V_L - V_R}{R} + \sum_{j=0}^{N-1}(N-j)I(j)\right) \tag{3c}$$

Then using equation (3c) in equation (A1) at node n:

$$V(n) = \left(V_L\frac{N-n}{N+1} - V_R\frac{n+1}{N+1}\right) + R\left(\sum_{j=0}^{n-1}(n-j)I(j) - \frac{n+1}{N+1}\sum_{j=0}^{N-1}(N-j)I(j)\right) \tag{3d}$$

From equation (3d) the following vector matrix equation is obtained:

$$V = M^{-1}(RI - V_b) \tag{3e}$$

where $$I = \begin{bmatrix} I(0) \\ I(1) \\ \vdots \\ I(N-2) \\ I(N-1) \end{bmatrix}, V = \begin{bmatrix} V(0) \\ V(1) \\ \vdots \\ V(N-2) \\ V(N-1) \end{bmatrix}, V_b = \begin{bmatrix} V_L \\ 0 \\ \vdots \\ 0 \\ V_R \end{bmatrix}$$

and $$M^{-1} = -\frac{1}{N+1}\begin{bmatrix} N & (N-1) & (N-2) & \cdots & 3 & 2 & 1 \\ (N-1) & 2(N-1) & 2(N-2) & & 6 & 4 & 2 \\ (N-2) & 2(N-2) & 3(N-2) & & 9 & 6 & 3 \\ \vdots & & & \iddots & & & \vdots \\ 3 & 6 & 9 & & 3(N-2) & 2(N-2) & (N-2) \\ 2 & 4 & 6 & & 2(N-2) & 2(N-1) & (N-1) \\ 1 & 2 & 3 & \cdots & (N-2) & (N-1) & N \end{bmatrix}$$

It is also useful to derive the result of the inverse matrix $M^{-1}$ operating on vector I to give the resultant vector F. The elements of vector F are given by:

$$F(n) = \sum_{j=0}^{N-1} M^{-1}(n, j)I(j) = \sum_{j=0}^{n-1}(n-j)I(j) - \frac{n+1}{N+1}\sum_{j=0}^{N-1}(N-j)I(j) \tag{4}$$

Computing the result of $M^{-1}$ on vector $V_b$ gives the result $$\sum_{j=0}^{N-1} M^{-1}(n, j)V_b(j) = \frac{1}{N+1}\{(N-n)V_L + (n+1)V_R\} \tag{5}$$

which simplifies to $V_P$ when $V_L = V_R = V_P$.

Equation (3) is the required general express ion for the power line voltage drops.

When a row of pixels is addressed a certain current will flow down the power line. After addressing a different current will flow due to the operation of the pixel circuits.

Different pixel circuits operate in different ways, as will be apparent to those skilled in the art.

By way of example, some pixel circuits carry our a threshold voltage measurement operation so that compensation can be carried out for ageing of the drive transistor. Such a circuit will have no current flowing on the power line whilst the data voltage is added i.e. no power line voltage drops. After this period, the programmed current will flow so there will be voltage drops on the power line which will cause cross-talk.

Another example is the matched current mirror circuit. In this case, two times the OLED current flows in the address period, after addressing only the OLED current flows, so the changes in current will cause cross-talk because the voltage changes on the power line will cause current changes in the pixel.

To find an expression for the pixel current changes due to the power line voltage drops and the output impedance of the in-pixel current providing TFT we use a simple diagrammatic approach.

Figure 5:
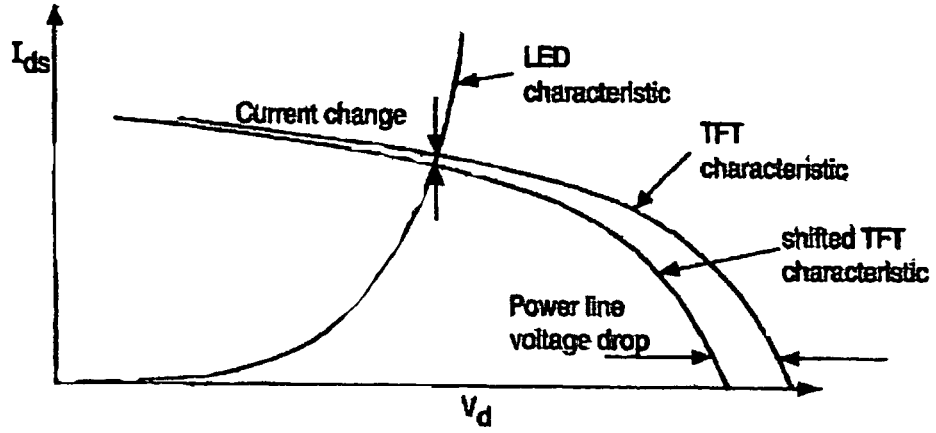
FIG. 5 is used to investigate the pixel output characteristics in response to changes in the row voltage.

FIG. 5 shows the TFT and LED characteristics. The TFT characteristic curve plots the drain source current ($I_{ds}$) against the drain voltage ($V_d$) for a constant gate-source voltage. When the drain voltage reaches the row voltage, the drain-source voltage reaches zero. Thus, increasing voltage in the graph of FIG. 5 corresponds to decreasing drain-source voltage, and the drain-source voltage is zero at the point where the curve crosses the x-axis. This point on the x-axis corresponds to the power line row voltage.

The shift in the TFT characteristics is the result of the change in the power line voltage, assuming the gate-source voltage remains constant.

The LED characteristic curve is a load line plot of the LED and shows the anode voltage of the LED display element for a given current.

Where the TFT characteristic curve crosses the LED characteristic curve, the drain/anode voltage is defined and the current flowing. As the TFT has a non-infinite output impedance when in saturation, movements in the power supply voltage shift the TFT characteristic to give different output currents, even for a constant gate-source voltage. Thus, the power line voltage change cannot be corrected simply by a corresponding change in the gate voltage in order to return the gate-source voltage to the same value.

The region of current change shown in FIG. 5 can be examined more closely in order to determine the change in anode/drain voltage and the change in current. This is shown in FIG. 6.

Figure 6:
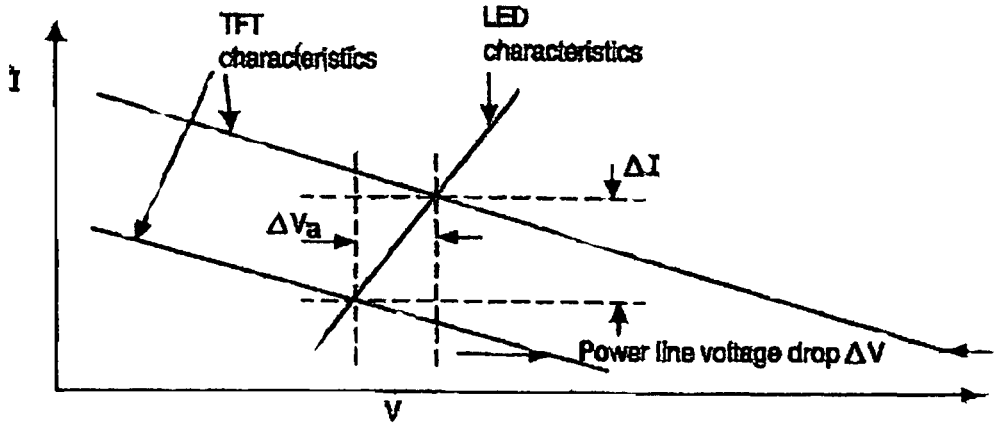
FIG. 6 shows a part of FIG. 5 in greater detail.

An examination of the geometry in FIG. 6 shows us that the current change is given by:

$$\Delta I = \frac{dI_{TFT}}{dV}\Delta V - \frac{dI_{TFT}}{dV}\Delta V_a \tag{6}$$

where $\Delta V_a$ is the change in LED anode voltage shown in FIG. 3, and the differential is simply the gradient of the TFT characteristic $\lambda(I)$. The LED characteristic is given by $I_{LED}=f(V_a)$ so we find $\Delta V_a$ by differentiating the LED characteristic i.e.

$$\Delta I = \frac{df}{dV}\Delta V_a = \mu(I)\Delta V_a \tag{7}$$

using equations (6) and (7):

$$\Delta I = \frac{\lambda(I)}{\left(1+\frac{\lambda(I)}{\mu(I)}\right)}\Delta V \tag{8}$$

If the initial voltages on the power line are caused by addressing currents $\alpha I$ we have voltage drops in the addressing period of $$V_i = M^{-1}(\alpha RI - V_b)$$

then after addressing we have currents I then the power line voltage drops become $$V_f = M^{-1}(RI - V_b)$$

therefore the difference in power line voltages are $$\Delta V = (1-\alpha)RM^{-1}I$$

Example values for $\alpha$ are zero for modified current source and voltage threshold measurement circuits, 1 for switched current mirrors (i.e. no cross-talk, but these pixel circuits are unsuitable for large displays), and greater than or equal to two for matched current mirror circuits. The greater than two case will occur if the matched TFT is wider than the driving TFT.

The initial currents $I_0$ on the row (after addressing) will cause a voltage drop of $\Delta V$ which in turn will cause $I_0$ to change to $I_1$ which will change the voltage drops which will change the current and so on. It is expected that $\lambda$ will be very small so a first order approximation is sufficient i.e.

$$I_1 = I_0 + \frac{\lambda(I_0)}{\left(1+\frac{\lambda(I_0)}{\mu(I_0)}\right)}(1-\alpha)RM^{-1}I_0 \tag{9}$$

The term $$D = \frac{\lambda(I_0)}{\left(1+\frac{\lambda(I_0)}{\mu(I_0)}\right)}$$

is a diagonal matrix.

To perform a correction of the current error we need to perform the inverse problem, in order to determine what set of data currents $I_0$ will lead to the desired currents $I_1$ after power line voltage drops occur. To solve this problem equation (9) is solved for $I_0$. As the problem stands this is extremely difficult because $\mu$ and $\lambda$ depend upon $I_0$, so as a further approximation it can be assumed that $\mu$ and $\lambda$ depend upon the known current $I_1$. This will be a good approximation if the current changes between $I_1$ and $I_0$ are small. The solution of equation (9) is then:

$$\begin{aligned} I_0 &= \left(1 + \frac{\lambda(I_1)}{\left(1+\frac{\lambda(I_1)}{\mu(I_1)}\right)}(1-\alpha)RM^{-1}\right)^{-1} I_1 \\ &\approx I_1 - \frac{\lambda(I_1)}{\left(1+\frac{\lambda(I_1)}{\mu(I_1)}\right)}(1-\alpha)RM^{-1}I_1 \end{aligned} \tag{10}$$

Equation (10) represents the solution to horizontal cross-talk due to TFT impedance and power line voltage drops. An algorithm for calculating the adjustment in current required to correct for horizontal cross-talk requires two steps:

Step 1: Given current data for a row $I_1$ calculate $M^{-1}I_1$.

Step 2: Store the data dependent values $(1-\alpha)R\lambda/(1+\lambda/\mu)$ in a Look-Up-Table (LUT) and multiply the output with the result of step 1 and then subtract the result from the initial data.

The algorithm could be iterated to improve the estimate of the corrected current by passing the result of step 2 back into step 1 and circulating through the steps until the desired correction is achieved, however it has been found that one pass is sufficient.

Figure 7:
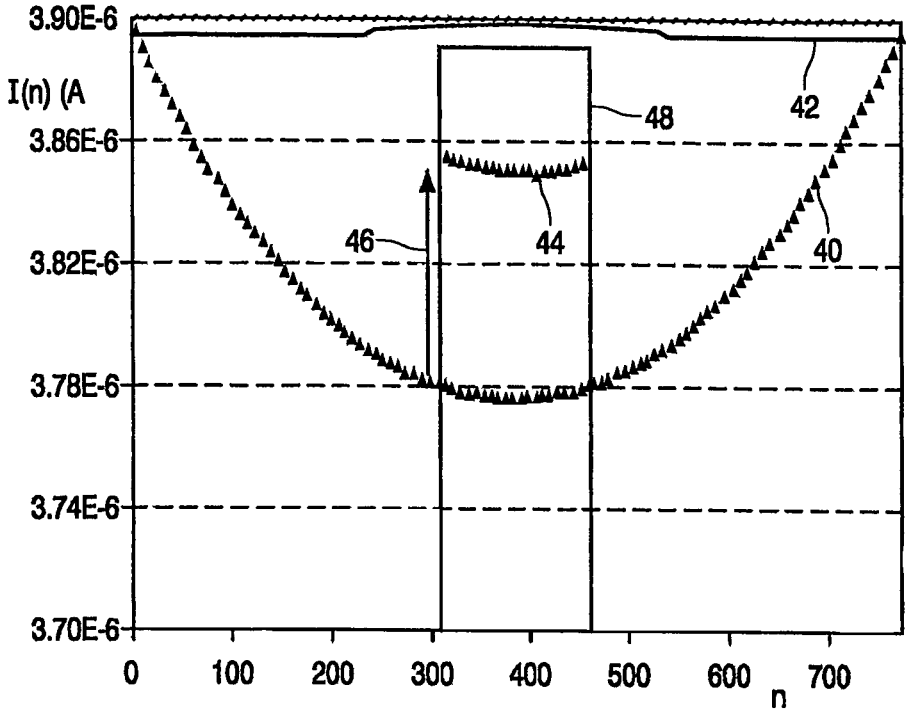
FIG. 7 shows, using graphs, the improvement obtained by the method of the invention.

FIG. 7 shows the effect of the correction algorithm. Plot 40 shows the calculated pixel current (I(n)) versus pixel position (n) when no correction has been applied and for a uniformly addressed bright image. There is a significant drop in pixel current in the middle of the display due to the combined effects of power line and pixel current source impedance.

Since light emission is almost proportional to current there is a similar drop in luminance. Plot 42 shows the calculated pixel current when the addressed current levels have been pre-adjusting according to a single pass of the algorithm described above. As can be seen the result is close to the horizontal straight line that is required.

Plot 44 shown in FIG. 7 is the calculated pixel current when only a central block of the display is addressed with the same brightness as above and the remainder is black (zero current). In this case, the drop in pixel current in the middle of the display is less, and the change in the cross talk effect is represented by arrow 46. For some displayed images, these different levels will give rise to a sharp step change in brightness where there should be none. This sharp step is far more visible than the smooth drop in brightness of a uniform image and is what is noticed when cross-talk is present.

Plot 48 shows the result of pre-adjusting the addressed current levels according to a single pass of the algorithm of the invention. The actual pixel currents in the centre of the display for both corrected images are now very similar such that no cross-talk would be visible. These results demonstrate the effectiveness of the proposed algorithm.

Figure 8:
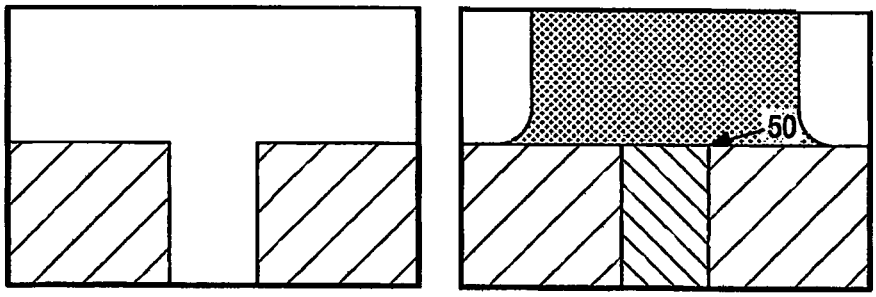
FIG. 8 shows, using images, the improvement obtained by the method of the invention.

FIG. 8 shows these cross talk effects using images. The image on the left is the desired image, and the image on the right shows how this may appear as a result of cross talk. The visible step in brightness 50 is the result of the effect explained with reference to arrow 46 in FIG. 7. The top half of the image is the uniform bright image and the bottom half of the image is the step image described with reference to FIG. 7.

For completeness, the parameters used in above example are as follows:

| | |
|---|---|
| Monochrome | |
| Maximum luminance | 250 Cd/m2 |
| Efficiency | 5.3 Cd/A |
| Aperture | 50% |
| Duty cycle | 50% |
| Pixel pitch | 144 μm |
| TFT width | 25 μm |
| No. pixels in row (N) | 768 |
| Line resistance per pixel (R) | 7.2 Ω |
| Maximum pixel current (I(n)max) | 3.9 μA |
| Power supply voltage (Vp) | 15 V |

The method of the invention can be implemented in an IC that operates upon the digital data stream. The top-level blocks required for this hardware implementation are set out below.

Step 1: Given current data for a row $I_1$ calculate $M^{-1} I_1$.

The implementation of $M^{-1}I$ could in general be a very computationally expensive calculation, especially for large images. Therefore a fast method of performing the calculation is essential. As seen in equation (4) the calculation of $M^{-1}I$ requires the evaluation of the sums shown below:

$$F(n) = \sum_{j=0}^{n-1} (n-j)I(j) - \frac{n+1}{N+1}\sum_{j=0}^{N-1}(N-j)I(j) \tag{11}$$

By calculating the difference of F(n) and F(n−1) a recursive relation for the elements F(n) can be found:

$$F(n) = \sum_{j=0}^{n-1} (n-j)I(j) - \frac{n+1}{N+1}\sum_{j=0}^{N-1}(N-j)I(j)$$

$$F(n-1) = \sum_{j=0}^{n-2} (n-1-j)I(j) - \frac{n}{N+1}\sum_{j=0}^{N-1}(N-j)I(j)$$

Therefore:

$$\begin{aligned} F(n) - F(n-1) &= \sum_{j=0}^{n-1} (n-j)I(j) - \sum_{j=0}^{n-2} (n-1-j)I(j) - \frac{1}{N+1}\sum_{j=0}^{N-1}(N-j)I(j) \\ &= I(n-1) + \sum_{j=0}^{n-2} (n-j)I(j) - \sum_{j=0}^{n-2} (n-1-j)I(j) - \frac{1}{N+1}\sum_{j=0}^{N-1}(N-j)I(j) \\ &= \sum_{j=0}^{n-1} I(j) - \frac{1}{N+1}\sum_{j=0}^{N-1}(N-j)I(j) \\ &= \sum_{j=0}^{n-1} I(j) + F(0) \end{aligned}$$

hence the recursive relation:

$$F(n) = F(n-1) + \sum_{j=0}^{n-1} I(j) + F(0) \tag{12}$$

where $$F(0) = \frac{1}{N+1}\sum_{j=0}^{N-1}(N-j)I(j)$$

Figure 9:
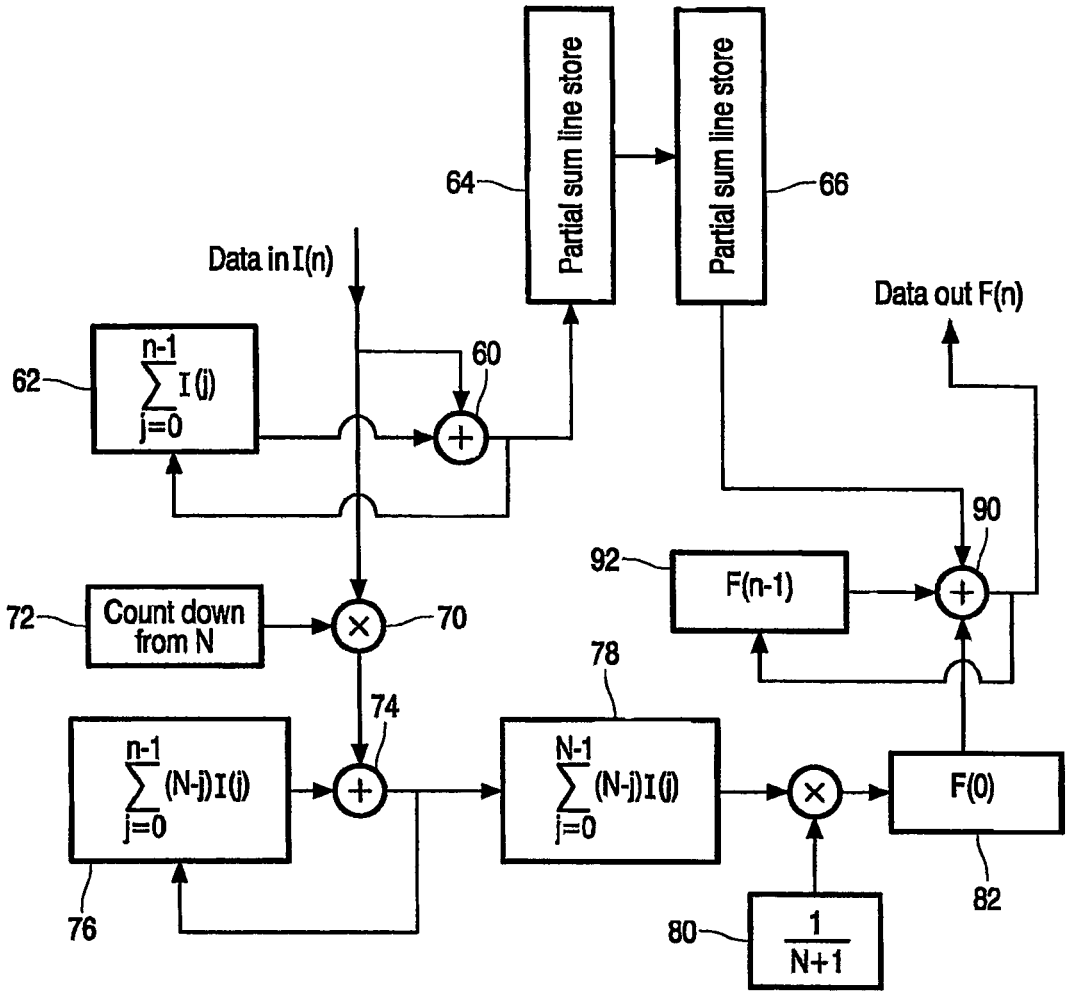
FIG. 9 shows circuitry for implementing part of the method of the invention.

The hardware shown in FIG. 9 is used to implement this calculation. In FIG. 9 the data is fed to an adder 60. The second input to the adder is from a register 62 containing a running sum of the previous data values on the line. This register will be zero after each line of data. The output of the sum is passed back to the register 62 and to a line store 64 that contains all of the partial data sums for that line. At the end of a line time the partial sum data is transferred in parallel to another line store 66, and this data will be used in the computation of equation (12).

The input data is also fed to a multiplier 70 whose second input comes from a counter 72 that counts down from N at the start of a line. The output of the multiplier is passed to an adder 74 whose second input comes from a register 76 that contains a running sum of the earlier inputs to the multiplier. This register is set to zero at the beginning of a line time. The output of the adder 74 is fed back to the register and to another register 78 that is only updated at the end of a line time. The output of this register is multiplied by a constant factor of −1/(N+1) contained in another register 80. The result is stored in another register 82 and is F(0) of equation (12).

The partial sum data in the line store and the value for F(0) stored in a register can now be used to calculate F(n) of equation (12). F(0) is passed to an adder 90 which is also fed with the partial sum data clocked serially out of the line store 66. These are added together with data from another register 92 containing F(n−1). At the start of a line time this register will be zero. The output of the sum is passed back to this register and is also the output of this computational block.

Step 2: Store the data dependent values $(1-\alpha)R\lambda/(1+\lambda/\mu)$ in a Look-Up-Table (LUT) and multiply the output with the result of step 1 and then subtract the result from the initial data.

Figure 10:
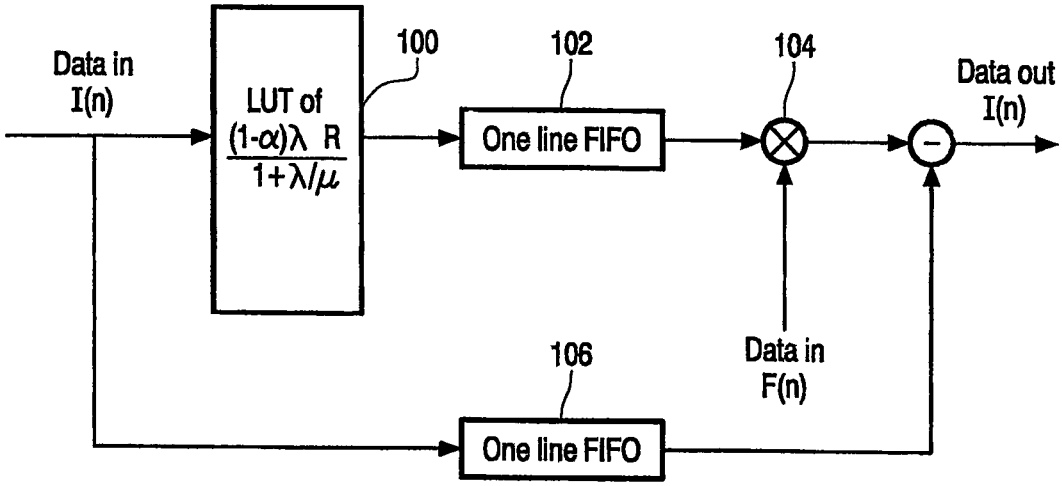
FIG. 10 shows circuitry for implementing another part of the method of the invention.

The remaining parts of the algorithm can be implemented as shown in FIG. 10.

The input data passes to a look up table 100 (LUT) to find the value of $(1-\alpha)R\lambda/(1+\lambda/\mu)$ corresponding to that input data value. The output of the LUT and the input data are then delayed by a line time using a FIFO 102. The output of the FIFO 102 passes to a multiplier 104 which is also fed with the F(n) values that have been calculated from the input data having also been delayed by one line time by FIFO 106. The output is then passed to a subtraction unit that subtracts this calculated correction from the input data to give the output data. This data is then passes to other processing units within the total video processing chain e.g. gamma correction.

As the OLED characteristic will vary according to temperature and age it is also be possible to update the LUT of FIG. 10 with new values to represent these changes. The LUT will need changing for different types of AMOLED display through parameter $\alpha$ e.g. modified current source, matched current mirror etc. or if the row resistance R changes for different manufactures or for different TFT output impedance characteristics. Therefore the LUT will need to be accessible and updateable.

The AMOLED display is typically constructed with additional pixel circuits outside the array and which are used for testing purposes. These may take the form shown in FIG. 11, and essentially model the behaviour of the drive transistor characteristics and of the row conductor resistance. These dummy pixel circuits have been proposed for use in threshold compensation schemes. The use of these dummy pixel circuits makes it possible to automatically generate and update the LUT over the lifetime of the display.

Figure 11:
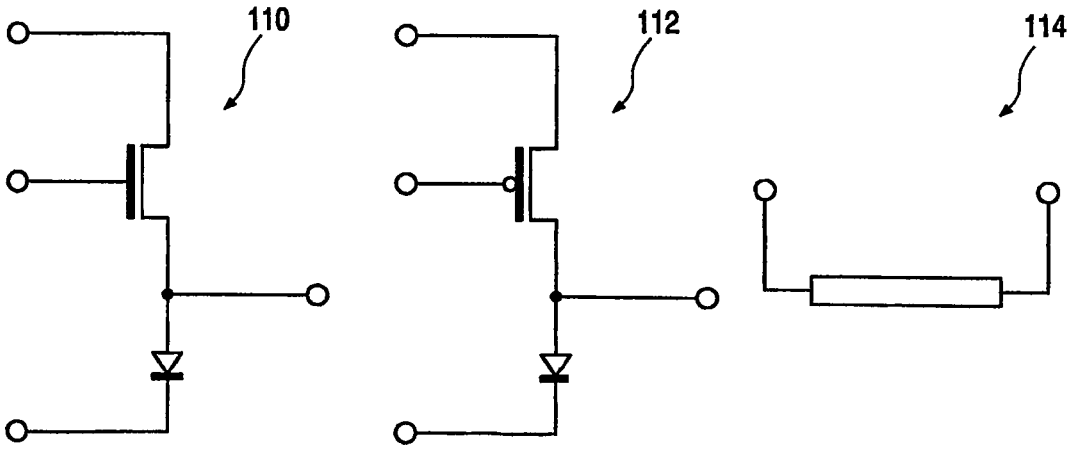
FIG. 11 shows dummy pixel circuits for use in a display of the invention.

FIG. 11 shows a dummy pixel 110 with an n-type transistor, a dummy pixel 112 with a p-type transistor and a resistor 114 which can be used to model the row conductor characteristics. Each circuit has terminals which allow test signals to be applied and outputs to be monitored. The PCMs shown in FIG. 11 are on the glass. There will be an n-type circuit for amorphous silicon circuits and a p-type circuit for low temperature polysilicon circuits.

The TFT output impedance as a function of current can be measured by varying the gate-source voltage of the TFT and measuring the current and the drain-source voltage of the TFT from the appropriate probe points on the circuit. Then the gradient of the data will be required to give $\lambda$. The same can be achieved for the OLED to give $\mu$. R can be determined by passing a current through a strip of metal N pixel lengths long and measuring the voltage to calculate the resistance in a pixel width strip of power line metal.

The display type will be dictate the value $\alpha$. All of this information enable the LUT to be calculated and updated through the lifetime of the display. The hardware to perform the measurements is straightforward and would possibly be included within the display driver chips. These would feed back the measured data to hardware in a controller chip to calculate the LUT and fill it.

In the above pixel circuit, a voltage-addressed current source is used. The invention can be applied to current-addressed pixels also, which typically store a transistor gate voltage corresponding to a sampled address current.

Only one detailed algorithm has been given, and some assumptions have been made to simplify the implementation of the method. Other assumptions may be made to arrive at a different algorithmic implementation, and the invention is not limited to the specific implementation described above.

The hardware example has been described as having numerous registers and logic elements. Many or all of the elements can be integrated into a dedicated processor architecture, and the hardware example is only one way of implementing the correction scheme of the invention.

Figure 1:
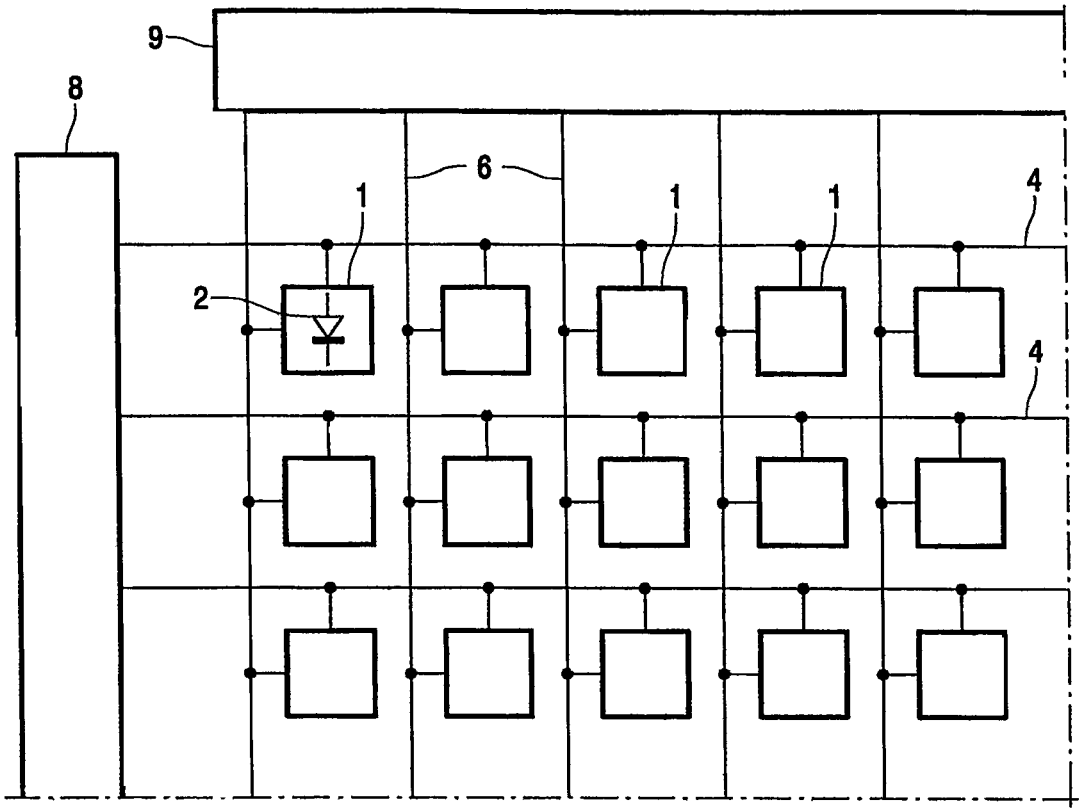
PRIOR ART FIG.1
FIG. 1 shows a conventional active matrix LED display.
Figure 2:
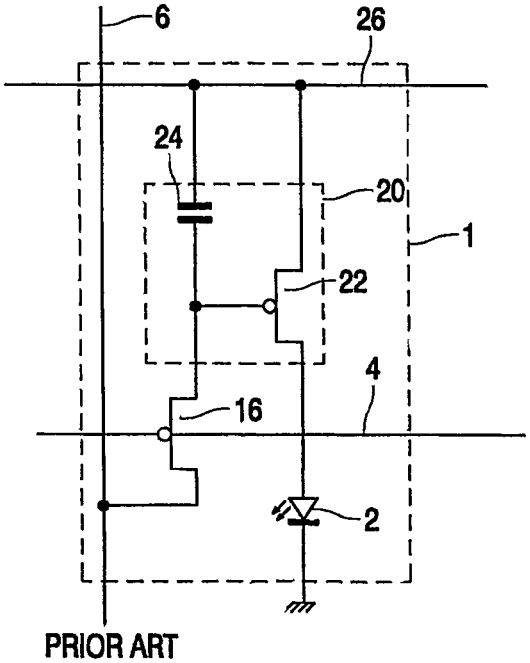
PRIOR ART FIG.2
FIG. 2 shows a conventional pixel layout for the display of FIG. 1.

The above analysis assumes a desired gate-source voltage can be applied to the pixel. Thus, when the modified currents have been calculated, the required gate-source voltage for driving the pixel will then need to be calculated for determining the pixel drive signals (for the pixel configuration of FIG. 2). This calculation can be carried out using the basic (constant) pixel model. The gate voltage to be applied to the pixel will again take into account the voltage on the row conductor at the pixel in order to obtain the desired gate-source voltage. Thus, the step of determining the pixel drive signals from the modified target pixel drive currents itself takes into account the row voltage at the pixel.

Other modifications will be apparent to those skilled in the art.

The invention claimed is:

1. A display device comprising an active matrix array of pixel elements comprising current-addressed light emitting display elements arranged in rows and columns and associated driver circuitry, said device comprising;

compensation circuitry for modifying target pixel drive currents to take account of a voltage at each of said pixel elements and a dependency of a brightness characteristic associated with a corresponding pixel, the compensation circuitry comprising:

means for applying an algorithm to the target pixel drive currents; and means for scaling the target drive currents by applying a value on the voltage on a conductor associated with a row containing the corresponding pixel element, said value being determined based on the dependency of the brightness characteristic of the corresponding pixel element, on characteristics of the driver circuitry associated with the pixel element and a ratio between a current drawn in a programming phase and a current drawn in a driving phase of the corresponding pixel element, wherein said ratio is dependent upon a display type.

2. The device as claimed in claim 1, wherein the means for applying an algorithm derives values corresponding to the multiplication of a vector of the target pixel drive currents for a row of pixel elements by the inversion of the matrix M, in which:

$$M = \begin{bmatrix} -2 & 1 & & & \\ 1 & -2 & 1 & & \\ & \ddots & \ddots & \ddots & \\ & & 1 & -2 & 1 \\ & & & 1 & -2 \end{bmatrix},$$

and wherein a number of rows and columns of matrix M is equal to a number of pixel elements in a row.

3. The device as claimed in claim 2, wherein the means for applying an algorithm derives values by a recursive operation $$F(0) = \frac{1}{N+1}\sum_{j=0}^{N-1}(N-j)I(j),$$

in which:

F(n) is an nth term of a vector result of multiplying the vector of the target pixel drive currents for a row of pixel elements by the inversion of the matrix M, F(0) being the first term; and I(j) is a target current for the jth pixel in a row, the first pixel being j=0.

4. The device as claimed in claim 3, wherein:

$$F(n) = F(n-1) + \sum_{j=0}^{n-1} I(j) + F(0),$$

in which:

N is a total number pixels in the row.

5. The device as claimed in claim 1, wherein each pixel element comprises:

a current source circuit comprising a drive transistor which converts an input voltage to a current and wherein the means for scaling determines the value derived from a current-voltage characteristic of the drive transistor; and a voltage-current characteristic of a corresponding current-addressed light emitting display element.

6. The device as claimed in claim 5, wherein the drive transistor and the light emitting display element of each pixel element are in series between the conductor associated with the row containing the corresponding pixel element and a common line.

7. The device as claimed in claim 6, wherein the value is derived from a drain-source voltage vs. a drain-source current characteristic of the drive transistor.

8. The device as claimed in claim 5, wherein the means for scaling the value is further derived from a resistance (R) of the conductor associated with the row containing the corresponding pixel element.

9. The device as claimed in claim 8, wherein the means for scaling (100) the value is determined as: $(1-\alpha)R\lambda/(1+\lambda/\mu)$, where:

R is the resistance of a conductor between adjacent pixel elements;

$\lambda$ is a slope of the current vs. voltage curve of the drive transistor;

$\mu$ is a slope of the current vs. voltage curve of the display element; and $\alpha$ is a ratio of a current drawn by a pixel element during the pixel programming phase to a current drawn by the pixel element during the driving phase.

10. The device as claimed in claim 1, wherein the means for scaling (100) comprises a look up table.

11. The device as claimed in claim 10, further comprising:

means for updating values of the look up table to enable changes in pixel brightness characteristics over time.

12. Compensation circuitry for modifying target pixel drive currents for a display device which comprises an active matrix array of current-addressed light emitting pixel elements arranged in rows and columns having a respective row conductor and a column conductor, the compensation circuitry comprising:

means for applying an algorithm to the target pixel drive currents, which represent a relationship between a current drawn by pixel elements in a row and a voltage on a conductor associated with the row at a corresponding location of the pixel elements in the row; and means for scaling the target pixel drive currents by applying a value to the voltage on the conductor associated with the row, said value being determined based on the dependency of the brightness characteristic of the corresponding pixel element, on characteristics of the driver circuitry associated with the corresponding pixel element and a ratio between a current draw in a programming phase and a current drawn in a driving phase of the corresponding pixel element, wherein said ratio is dependent upon a display type.

13. The compensation circuitry as claimed in claim 12, wherein the means for applying an algorithm derives values corresponding to the multiplication of a vector of the target pixel drive currents for a row of pixels by the inversion of the matrix M, in which:

$$M = \begin{bmatrix} -2 & 1 & & & \\ 1 & -2 & 1 & & \\ & \iddots & \iddots & \iddots & \\ & & 1 & -2 & 1 \\ & & & 1 & -2 \end{bmatrix},$$

and wherein a number of rows and columns of matrix M is equal to a number of pixels in a row.

14. The compensation circuitry as claimed in claim 12, wherein the means for scaling comprises a look up table.

* * * * *